United States Patent [19]

Antal et al.

[11] Patent Number: 4,898,554

[45] Date of Patent: Feb. 6, 1990

[54] METHOD OF AND EQUIPMENT FOR AGEING A LOW-PRESSURE HOT-CATHODE DISCHARGE LIGHT SOURCE, PARTICULARLY A FLUORESCENT LAMP

[75] Inventors: Kálmán Antal; Béla Rimay; Ferenc Halász, all of Budapest, Hungary

[73] Assignee: Tungsram Részvénytársaság, Budapest, Hungary

[21] Appl. No.: 326,802

[22] Filed: Mar. 21, 1989

[30] Foreign Application Priority Data

Apr. 22, 1988 [HU] Hungary ..... 2039/88

[51] Int. Cl.[4] ..... H01J 9/44

[52] U.S. Cl. ..... 445/6; 445/62

[58] Field of Search ..... 445/6, 62, 71

[56] References Cited

U.S. PATENT DOCUMENTS 2,977,176 3/1961 McCauley ..... 445/6

4,195,253 3/1980 Drop et al. ..... 455/6

FOREIGN PATENT DOCUMENTS 12610 1/1980 Japan ..... 445/6

700883 11/1979 U.S.S.R. ..... 445/6

*Primary Examiner*—Kenneth J. Ramsey

*Attorney, Agent, or Firm*—Spencer & Frank

[57] ABSTRACT

The ageing process of a low-pressure hot-cathode gas discharge light source, especially a fluorescent lamp is carried out by applying high alternating voltage being at least 8 times and at most 16 times higher than the burning voltage rating of the gas discharge light source after preheating electrodes thereof, whereby a short discharge arc is generated and then after changing the connecting arrangement of the input terminals of the electrodes the application of high alternating voltage is repeated. The equipment for carrying out the process of ageing comprises at least one supply unit for generating high alternating voltage being at least 8 and at most 16 times higher than the burning voltage rating of the gas discharge light source, at least one ignition system for breaking a circuit at maximal momentary value of a preheating current applied to electrodes of the light source and means for changing the connecting arrangement of output terminals of the electrodes to the supply unit and for altering output connection terminals of the supply unit with at least one current source.

14 Claims, 1 Drawing Sheet

METHOD OF AND EQUIPMENT FOR AGEING A LOW-PRESSURE HOT-CATHODE DISCHARGE LIGHT SOURCE, PARTICULARLY A FLUORESCENT LAMP

FIELD OF THE INVENTION

The present invention refers to a method of and an equipment for ageing a low-pressure hot-cathode gas discharge light source, particularly a fluorescent lamp, comprising the steps of preheating two electrodes of a sealed gas discharge light source by connecting the over respective input terminals to a supply unit for forwarding electric preheating current, generating a discharge arc between the preheated electrodes by applying voltage equal with or exceeding the burning voltage rating of the light source to the input terminals, maintaning the discharge arc for a time in a predetermined period and breaking the discharge arce after passing the time defined above.

BACKGROUND OF THE INVENTION

The discharge vessels of the low-pressure hot-cathode gas discharge light sources contain a filling comprising a rare gas and a mercury based additive. In the end parts of the discharge vessels there are electrodes equipped with two output terminals, the electrodes being sealed in the end part. The electrodes are covered with an emission substance of low escape energy, whereby the emission of the electrons from the surface of the electrodes and generating of the discharge arc is ensured. The electrodes of this kind are the oxide based cathodes. The emission substance is prepared by covering the emission surfaces by an appropriate carbonate and during the pumping step of production of the fluorescent lamp that carbonate covering layer is transformed into appropriate oxide by cathode breakdown. This is a well-known step of the technology.

After the pumping step the electrodes of the discharge vessel are formed further by an ageing process. During this process a basic point of the discharge arc can be formed on the covering oxide layer of the electrodes sealed in the discharge vessel. The ageing process results in required ignition and operation parameters of the gas discharge lamp, e.g. the fluorescent lamp. Thus, the process of ageing is carried out for preparing the low-pressure hot-cathode gas discharge light source to operating, i.e. for lowering the ignition voltage of the gas discharge light source, particularly fluorescent lamp to the required value and for providing the stabilization process of the electric parameters.

The process of ageing according to the art comprises the steps of preheating the electrodes of a gas discharge light source, applying to the preheated electrodes a voltage being equal with or slightly exceeding the burning voltage rating of the gas discharge light source, generating thereby the discharge arc by applying, if necessary at the first time auxiliary means for facilitating the generating process mentioned and maintaining the discharge arc. This cycle of operations, shown e.g. in the US-PS 2 977 176, lasting relatively long time, generally from 350 to 600 seconds, is repeated more times. The process disclosed in the US-PS 2 977 176 is proposed to be applied in systems for producing gas discharge light sources wherein the cycles described are repeated many times resulting in an ageing technology requirring about one hour time until completing.

The known solutions of the art applied in ageing the gas discharge light sources of specified kinds can be characterized by relatively long cycles and this is the general disadvantage of the recently known highly developed technology of producing gas discharge light sources, particularly fluorescent lamps. This technology ensures high efficiency by the output of the modern production lines can not be followed by the known equipment of ageing. The quantities of the gas discharge light sources produced by the highly developed kinds of the technology lines renders it necessary to assign great surface to the equipment capable of carrying out the ageing step.

SUMMARY OF THE INVENTION

The object of the present invention is to provide an improved method of ageing a gas discharge light source, particularly a fluorescent lamp, which method can be carried out in a short time according to the requirements of the production technology of the light sources, i.e. renders substantial reduction of the time of the ageing process possible.

The invention is based on the recognition that for generating the discharge arc between the electrodes of a gas discharge light source the ageing the technology should be realized with voltage being much higher than the burning voltage rating applied to the gas discharge light source, i.e. than the voltage to be applied for ignition in normal operating conditions. This recognition results in a feature opposing to and not findable in the present practice followed in this field of technology. The general conviction has been - as it is is disclosed e.g. in the Swiss patent specification CH-PS No. 306 778 - that the high voltage applied to the electrodes can involve damages to them because of resulting in cathode sputtering. The investigations verified, however, that no consequence of this kind can be observed. The conditions of ageing proposed by the present invention do not cause intensive cathode sputtering and by them it is possible to achieve a very high reduction of the time of the ageing process, and thereby to decrease the dimensions of the equipment capable of carrying out the proposed ageing technology.

Hence, the essence of the recognition is that during the ageing process in the first step the condition of the reliable ignition of the discharge arc should be established, after which a short high-voltage ignition and ageing step follows. The short time means generally the interval from 1 to 2 seconds, the high voltage exceeds at least 8 times and at most 16 times the burning voltage rating of the given gas discharge light source, it is generally in the range of about 1000 V. In these conditions the discharge current represents generally about 60 to 80% of the operating current rating of the light source, which is particularly a fluorescent lamp.

It is very advantageous if the high-voltage period of the ageing process is followed by a second and a third periods of ageing wherein the voltage applied for generating the discharge arc is induced after preheating carried out during the time interval specified above, the voltage being applied in an inductance circuit and having a value equal to the normal burning voltage rating of the light source or slightly exceeding it, wherein the duration of applying this voltage is short, amounts advantageously from 1 to 2 seconds. The ignition ensured at the maximal value of the preheating current means that the gas discharge light source, especially a fluorescent lamp receives a voltage pulse of predetermined peak value and energy content on igniting. In this way the ignition can be ensured with high reliability.

In the second and third periods of the ageing process the voltage applied to the gas discharge light source gives the only difference in the steps, the voltage being in the second period slightly higher than the burning voltage rating and in the third period it is substantially equal to this rating.

In each of the three mentioned periods of ageing the electrodes are preheated by means of a current having a value in the range of 0,8 to 1,2 times of the effective value of the preheating current characteristic to the given kind of the gas discharge lamp. The preheating step lasts as long as required.

On the basis of the recognitions a method was realized for ageing a low-pressure hot-cathode gas discharge light source, particularly a fluorescent lamp, comprising the steps of preheating two electrodes of a sealed gas discharge light source, preferably a fluorescent lamp by connecting it over respective input terminals to a supply unit forwarding electric preheating current, generating a discharge arc between the preheated electrodes by applying voltage equal with or exceeding the burning voltage rating of the light source to the input terminals, maintaining the discharge arc for a time selected to be in a predetermined interval and breaking the discharge arc after passing this time, repeating at least once the generating maintaining and breaking steps forming a cycle of operations and checking selected operating parameters of the gas discharge light source. The essence of the invention lies in carrying out a specific ageing process divided advantageously into three phases. The first phase as specified according to the following, is carried always out. Many gas discharge light sources requires only this phase for completing the ageing process. If it is not sufficient then a second and a third phases follow.

According to the invention in the first phase of the ageing process in the sealed gas discharge light source, particularly a fluorescent lamp, to the preheated electrodes an alternating voltage is applied which is of effective value exceeding at least 8 times and at most 16 times the burning voltage rating of the gas discharge light source, it lies preferably in the range from 800 V to 1600 V, then the discharge arc is maintained for a short time, expediently from 1 to 2 seconds and the cycle of operations is repeated with the mentioned parameters after changing the connecting arrangement of the input terminals to the source of the increased alternating voltage, wherein the increased alternating voltage is selected in the frequency range expediently from 50 Hz to 50 kHz.

The second and third phases of the ageing process are realized after preheating the electrodes during the predetermined time interval when the circuit is interrupted in the moment of reaching the maximal value of the preheating current, the induced high voltage constitutes a pulse capable of generating the discharge arc which is maintained short time, expediently from 1 to 2 seconds. The discharge arc is generated in the second phase by means of a voltage being from 10 to 20% higher than the burning voltage rating of the gas discharge light source, and in the third phase by means of a voltage being substantially equal with the burning voltage rating. In the second as well in the third phases the gas discharge arc should be interrupted, and the cycle of operations repeated at least once, after previous changing of the connecting arrangement of the input terminals to the source of the alternating voltage, having frequency selected expediently also in the range from 50 Hz to 50 kHz.

The object of the invention is also an equipment capable of carrying out the proposed method of ageing a low-pressure hot-cathode gas discharge light source, especially for carrying out the method in connection with fluorescent lamps. The equipment comprises a current source for generating current with intensity selected in a controlled manner in the range from 0.1 A to 2.0 A to be applied to the preheating electrodes of the gas discharge light source, preferably a fluorescent lamp and a supply unit for generating voltage to be applied to the preheating electrodes, the suppply unit including means for limiting current, particularly a choking coil, the voltage being equal with the burning voltage rating of the gas discharge light source or slightly exceeding this burning voltage rating and having frequency selected in the range from 50 Hz to 50 kHz. The essence of the invented equipment is that for accelerating the process of ageing of the gas discharge light source it comprises at least one galvanically isolated current source for supplying current to the preheating electrodes of the gas discharge light source, the at least one current source constituting expediently a current generator, at least one supply unit comprising the current limiting means, being capable of generating alternating voltage in the value range exceeding at least 8 times and at most 16 times the burning voltage rating, the alternating voltage lying expediently in the range from 800 V to 1600 V and having particularly a frequency selected in the range from 50 Hz to 50 kHz, at least one ignition system resulting in breaking a circuit at maximal momentary value of the current supplied to the preheating electrodes, means for changing the connecting arrangement of output terminals of the gas discharge light source, particulary the fluorescent lamp to the at least one supply unit and for alterning the output connecting terminals of the supply units and current sources and preferebly at least one further supply unit for generating controlled lower alternating voltage with frequency selected particularly in the range from 50 Hz to 50 kHz.

The frequency value or frequency range of the alternating voltages ensured by the supply units depends mainly on practical aspects. The lower frequency limit is preferably the network frequency, i.e. 50 Hz or 60 Hz, and the upper limit is determined by the electronic arrangement of the circuits. Under aspect on energy savings the high frequency supply units are very advantageous, however their application is linked with some other technical problems, e.g. with the reliability of the insulation systems.

The method and equipment proposed by the invention renders very effective shortening of the ageing process in production of gas discharge light sources, especially fluorescent lamps possible.

BRIEF DESCRIPTION OF THE DRAWINGS

The invention will be described in more detail by way of the followng non-limiting examples and with reference to a preferred embodiment illustrated inthe drawings, wherein.

DESCRIPTION OF THE PREFERRED EMBODIMENTS

Figure 1:
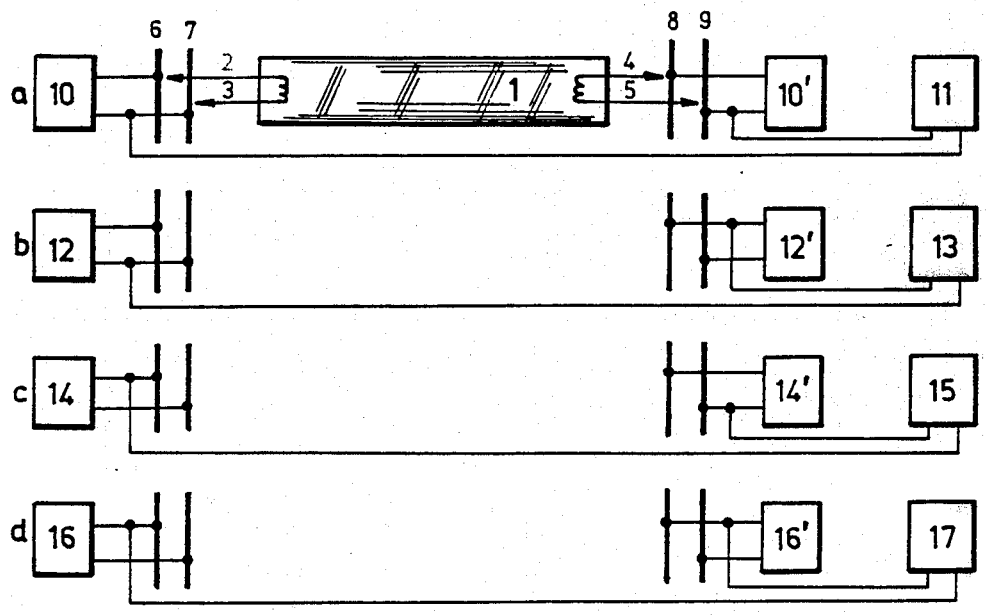
FIG. 1 is a schematic circuit arrangement of an equipment for carrying out the proposed ageing process by means of a first phase of ageing.

The equipment realized according to the invention for ageing a low-pressure hot-cathode gas discharge light source, especially a fluorescent lamp (FIG. 1) is shown in connection with a fluorescent lamp 1. The fluorescent lamp 1 is equipped with electrodes having output terminals 2, 3, 4, 5 connected by means of sliding contacts to tracks 6, 7, 8, 9 divided into sections a, b, c, d. Over the sliding contacts the electrodes of the fluorescent lamp 1 are connected with current sources 10, 10', 12, 12', 14, 14', 16, 16' arranged in pairs on both side of the fluorescent lamp 1. The tracks 6, 7, 8, 9 are connected in a manner depending on the given conditions of the ageing process to supply units 11, 13, 15, 17.

Figure 2:
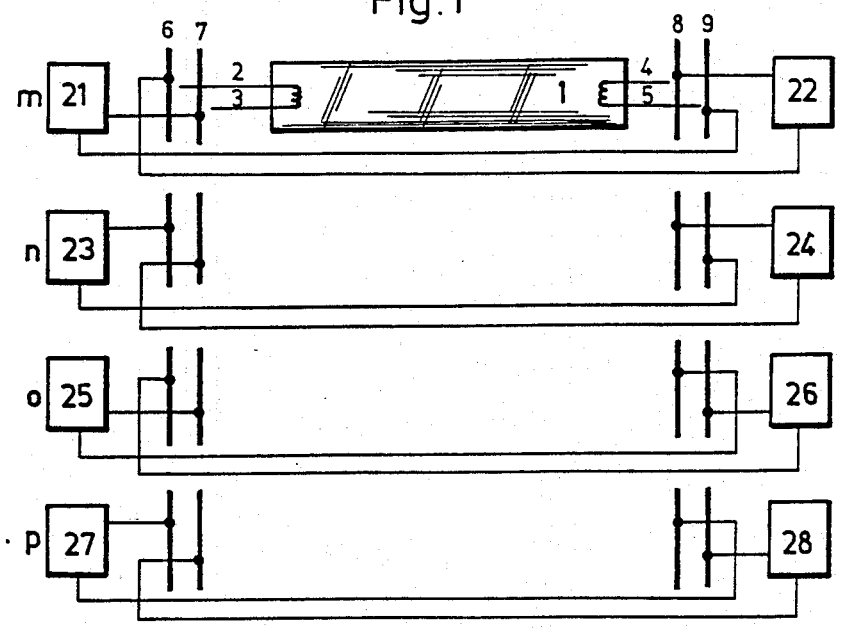
FIG. 2 is a schematic circuit arrangement of an equipment for carrying out a second and a third phases of the ageing process of the invention.

If required, the arrangement of FIG. 1 can be followed by a further arrangement according to FIG. 2 for carrying out further phases of the ageing process. As it is shown in FIG. 2, this auxiliary arrangement comprises -also in a contactable manner to the fluorescent lamp 1 - tracks 6, 7, 8, 9 divided into sections m, n, o, p, ignition circuits 21, 23, 25, 27 for preheating the electrodes of the fluorescent lamp 1 and supply units 22, 24, 25, 28.

The method of the invention is illustrated in the following by reference to the FIG. 1 and FIG. 2 by way of the example of ageing a 18 W fluorescent lamp.

The fluorescent lamp is arranged in the first position of the equipment according to the invention wherein the output terminals 2, 3, 4, 5 of the electrodes are connected by means of the sliding contacts to the section a of the tracks 6, 7, 8, 9. In this position the current sources 10 and 10' ensure preheating current for the electrodes of the fluorescent lamp 1. The fluorescent lamp 1 of light output 18 W requires generally preheating current about 400 mA. The output terminals 2 and 3 on one side are connected to the tracks 6 and 7, respectively, the output terminals 4 and 5 to the tracks 8 and 9, respectively. The supply unit 11 is connected with the tracks 7 and 9.

After preheating the electrodes the supply unit 11 gives alternating voltage 980 V of 24 kHz to the electrodes. At the section a the fluorescent lamp is connected by means of the output terminals 5 and 3 to the supply unit and under influence of the alternating voltage applied the discharge arc comes into being between the electrodes. This discharge arc is maintined short time, in the given example only 1 second. After completing this step the fluorescent lamp 1 is translated to the section b, wherein the high alternating voltage of 980 V and 24 kHz parameters is ensured by means of the supply unit 13. This is the second step of the ageing process. The third step is carried out in section c by means of similar high alternating voltage supplied by the supply unit 15 to the output terminals 2, 5 and the fourth step in section d by means of the supply unit 17 ensuring similarly to the supply units 11, 13, 15 high alternating voltage of 980 V and 24 kHz parameters. After the preceding four steps two similar cycles including eight similar steps are carried out. The first phase of the ageing is thereby completed in twelve steps, by applying twelve times high alternating voltage of expediently equal parameters.

As mentioned, in case of some kinds of the gas discharge light sources the first phase, comprising the completion of the mentioned four steps at least two times, may be sufficient for realizing the ageing process.

The example of the fluorescent lamp having light output 18 W shows that the ageing process may be completed by a second and third phases.

The second phase begins from the thirteenth position in the section m as shown in FIG. 2. (The fifth and ninth steps are carried out in the section a, the sixth and tenth in the section b, the seventh and eleventh steps in the section c, and the eighth and twelfth steps in the section d). The thirteenth step comprises preheating the electrodes by means of the ignition circuit 21 and the supply unit 22. At the momentary maximal value of the preheating current the ignition circuit 21 interrupts the circuit comprising an inductive element and thereby ensures the maximally reliable ignition of the discharge arc. The ignition circuits 21, 23, 25 and 27 are built-up on the basis of thyristors. The discharge arc is maintained by the supply unit 22, 24, 26, 28 of controlled output voltage for short time. In the case of the fluorescent lamp of the example the supply units 22, 24, 26, 28 are controlled to forward output voltage in the range from 190 to 240 V.

The voltage ensured by the supply units 22, 24, 26, 28 can be controlled by selecting of the tap point prepared in the secondary side of a transformer. The tap point arrangement of the transformer gives a possibility of determining the output voltage of the supply unit 22, 24, 26 and 28. The thirteenth step of the ageing process includes the application of voltage with effective value 240 $V_{eff}$ for supplying the fluorescent lamp 1. The same voltage is applied in the further seven steps, wherein in each step, similarly to the cycles of the first four steps the output terminals 2, 3, 4 and 5 of the electrodes are changed. The equipment works in this phase in a duplex system. The second phase of the ageing process lasts eight steps, in each of them with 1 second duration of applying the voltage of the discharge arc, wherein in each of the sections m, n, o and p the step is carried out two times.

The third phase of the ageing process begins in the twentieth position assigned also to the section m. This is the twentieth step of the ageing process. The fluorescent lamp 1 connected to the means of the section m undergoes the same processing as in the thirteenth and seventieth steps of the ageing process with the difference that the supply unit 22 ensures alternating voltage having effective value 220 $V_{eff}$. The discharge arc is maintained here also short time, generally only 1 to 2 seconds. This third phase of the ageing process lasts seven steps, i.e. the fluorescent lamp 1 is processed two times in the section m, n and once in the positions o and p, preferably with 220 $V_{eff}$ alternating voltage as in the twentieth step.

The third phase of the ageing process is finished in the case of the 18 W fluorescent lamp in the twenty-sixth step, after processing in the section n.

The ageing process itself is completed by checking selected parameters of the fluorescent lamp 1. This means, in the position o, in the twenty-seventh step the fluorescent lamp 1 is connected with a supply unit for supplying voltage of 190 $V_{eff}$ value and an optical detector is applied for checking whether the fluorescent lamp 1 works, the ignition is completed. A further detector measures the so-called ignition voltage characterizing the fluorescent lamps 1 during operation.

In the position p, i.e. in the twenty-eighth step of the ageing process the resistance of the cathode filament which is in the present example 400 mA if the heating current is adjusted to the predetermined value.

The main advantage of the method and equipment proposed by the invention is that the ageing process lasts until it is completed very short time, and depending on the translation speed between the separate sections of the equipment according to the invention it can be shortened to duration as long as 28 to 30 seconds. This offers the possibility of diminishing the dimensions of the equipment and thereby improving the exploitation possibilities of the production areas.

The previous example is shown only for better understanding of the invention. From the above description, it should be understood, that methods and kinds of equipment equivalent to those specified above will be within the scope of the claimed invention and such kinds of equipment, the specific parameters of the processes will depend on the gas discharge light sources to be aged. Therefore the scope of the protection is not limited by the example given above but by the appended claims.

What we claim is:

1. In a method of ageing a low-pressure hot-cathode gas discharge light source comprising the steps of preheating two electrodes of a sealed gas discharge light source by connecting their input terminals to a supply unit forwarding electric preheating current, generating a discharge arc between said preheated electrodes by applying voltage equal with or exceeding the burning voltage rating of said light source connected to said input terminals, maintaning said discharge arc for a time selected to be in a predetermined period and breaking said discharge arc after passing said time selected, said generating, maintaning and breaking steps forming a cycle of operations, repeating at least once said cycle and checking selected operating parameters, the improvement of applying in generating step increased alternating voltage being at least 8 times and at most 16 times higher than said burning voltage rating of said gas discharge light source, maintaning said discharge arc for a short time and changing the connecting arrangement of said input terminals to said source of said increased alternating voltage each time before carrying out said repeating step, for accelerating the process of ageing.

2. The method as set forth in claim 1, characterized in carrying out said generating step by increased alternating voltage having frequency selected in the range from 50 Hz to 50 kHz.

3. The method as set forth in claim 1, characterized in carrying out said maintaining step with discharge arc lasting from 1 to 2 seconds.

4. The method as set forth in claim 1, characterized in comprising the further step of repeating said cycle at least two times with lower alternating voltage exceeding at most by 20% said burning voltage rating of said gas discharge light source.

5. The method as set forth in claim 1, characterized in comprising the further step of generating said discharge arc between said preheated electrodes after the said cycles applying said increased alternating voltage by disconnecting a circuit of forwarding said electric preheating current by an ignition circuit in the moment of said electric preheating current having its momentary maximal value or a value in the near proximity of said maximal value, maintaining said discharge arc by applying lower alternating voltage exceeding said burning voltage rating by 10 to 20% for a short time.

breaking said discharge arc and changing said connecting arrangement of said input terminals to said source of said lower alternating voltage, then repeating at least once said maintaining, breaking and changing step by applying said lower alternating voltage being substantially equal to said burning voltage rating of said gas discharge light source.

6. The method as set forth in claim 5, characterized in carrying out said maintaining step with discharge arc lasting from 1 to 2 seconds.

7. The method as set forth in claim 5, characterized in carrying out said generating step by lower alternating voltage having frequency selected in the value range from 50 Hz to 50 kHz.

8. Apparatus for ageing a low-pressure hot-cathode gas discharge light source, comprising a current source means for generating current with intensity selected in a controlled manner in the range from 0.1 A to substantially 2 A to be applied to said preheating electrodes of a gas discharge light source, and a supply unit means for generating voltage to be applied to said preheating electrodes, said supply unit including means for limiting current, the voltage being equal to the burning voltage rating of said gas discharge light source or slightly exceeding said burning voltage rating, the improvement comprising at least one galvanically isolated current source source for supplying current to said preheating electrodes, at least one supply unit comprising said current limiting means, being capable of generating alternating voltage in the value range exceeding at least 8 times and at most 16 times said burning voltage rating, said supply unit comprising at least one ignition system resulting in breaking a circuit at maximal momentary value of said current supplied to said preheating electrodes and including means for changing a connecting arrangement of output terminals of said gas discharge light source to said at least one supply unit and for altering output connecting terminals of said at least one supply units and at least one current source.

9. The apparatus as set forth in claim 8, characterized in comprising at least one further supply unit of controlled lower alternating voltage having value in the range from said burning voltage rating to a level exceeding substantially by 20% said operating voltage rating of said gas discharge light source.

10. The apparatus as set forth in claim 9, characterized in that at least one supply unit is capable of generating alternating voltage having frequency selected in the range from 50 Hz to 50 kHz.

11. The apparatus as set forth in claim 8, characterized in that at least one supply unit is capable of generating alternating voltage having frequency selected in the range from 50 Hz to 50 kHz.

12. Apparatus as set forth in claim 8 wherein said alternating voltage ranges from 800 V to 1600 V.

13. Apparatus as set forth in claim 8 wherein said current source comprises current generator means.

14. Apparatus as set forth in claim 8 wherein said current limiting means comprises a choking coil.

* * * * *